US005422166A

United States Patent [19]

Fleischer

[11] Patent Number: 5,422,166

[45] Date of Patent: Jun. 6, 1995

[54] ABRASION RESISTING EDGE FOR A FORMING FABRIC

[75] Inventor: Thomas B. Fleischer, Pelzer, S.C.

[73] Assignee: Wangner Systems Corporation, Greenville, S.C.

[21] Appl. No.: 17,004

[22] Filed: Feb. 12, 1993

[51] Int. Cl.[6] ..... B32B 23/02

[52] U.S. Cl. ..... 428/193; 428/194; 428/196; 428/141; 428/245; 162/903

[58] Field of Search ..... 428/193, 194, 245, 196, 428/141; 162/903, 348

[56] References Cited

U.S. PATENT DOCUMENTS 3,523,867 8/1970 Macbean ..... 162/348
4,533,594 8/1985 Buchanan ..... 428/236
4,917,937 4/1990 Lappanen et al. ..... 428/196
5,084,326 1/1992 Vohringer ..... 428/194

*Primary Examiner*—George F. Lesmes
*Assistant Examiner*—Christopher W. Raimund
*Attorney, Agent, or Firm*—Henry S. Jaudon; Cort Flint

[57] ABSTRACT

A forming fabric woven of synthetic continuous warp and weft filaments which is adopted for use with a papermaking machine. The forming fabric is formed with a support surface and a running surface with the running surface having abrasion resistant areas arranged along its length adjacent each of its edges. The abrasion resistant areas comprise abrasion resistant polyurethane impregnated to penetrate and bond with and about the warp and weft filament throughout the thickness of the forming fabric. The polyurethane forms protrusions on at least the running surface of the forming fabric.

15 Claims, 3 Drawing Sheets

ABRASION RESISTING EDGE FOR A FORMING FABRIC

BACKGROUND OF THE INVENTION

The invention relates to forming fabrics for use with paper making machines. In use, the forming fabric is moved through the papermaking machine at speeds in excess of 2000 meters per minute while passing over suction boxes and rollers. Because of the contact with the suction boxes, is only with the outer areas of the forming fabric, excessive wear occurs in these areas. The fabric of the invention reinforces these outer areas.

Numerous attempts have been made to eliminate this problem. One such attempt is taught in the arrangement of U.S. Pat. No. 4,917,937 where molten plastic is applied to the surface of the forming fabric as a plurality of configured rows of plastic material. This patent does not disclose a particular plastic nor does it disclose having the plastic forced into the interstices of the forming fabric to bond with the internal warp and weft yarns constituting the forming fabric.

U.S. Pat. No. 5,084,326 is also directed to providing abrasive resistant areas adjacent opposed edges of a forming fabric. The '326 patent discloses applying strips of abrasion resistant plastic material incorporated with a melting adhesive to opposed edges of the forming fabric in various spaced patterns. The abrasive material only partially penetrates the forming fabric and is secured thereto by the adhesive incorporated therewith. The abrasion resistant material which is a polyester or polyamide mixed with a melting adhesive may be in the form of threads or particles.

German Patent application (DE-052922025) is directed to almost the same subject matter as the '326 patent referred to above. Here a paper forming fabric has wear resistant areas formed by applying a wear resistant plastic or polymer at wear areas. The materials disclosed are polyamide and polyester; no polyurethanes. The reference discloses the use of formaldehyde resin which acts with the above plastics as an adhesion promoter.

The instant invention has as its object to provide a forming fabric for a papermaker's machine having abrasion resistant zones along longitudinal edge portions of the fabric.

Another object of the invention is to provide a forming fabric with abrasion resistant areas and yet have substantially undiminished dewatering properties.

Another object of the invention is to provide a forming fabric having abrasion resistant areas capable of withstanding the temperatures and operational speeds at which the fabric must function.

SUMMARY OF THE INVENTION

The instant invention is directed to a continuous forming fabric for use in a paper making machine. The forming fabric is woven of continuous filament warp and weft yarns and is constructed to have a support surface and a running surface. The forming fabric includes, a pair of unfinished edges extending along its length. There are also abrasion resistant areas extending along the length of the forming fabric adjacent the respective opposed edges. Abrasion resisting material covers and extends above at least a portion of the abrasion resistant areas of the running surface. The abrasion resisting material comprises a polyurethane impregnated into the interstices of the forming fabric to bond about the warp and weft filaments so provide abrasion resistant areas along the length of at least the running surface.

The unfinished edges may be stabilized by being heat sealed and impregnated with a polyurethane coating which passes completely through the forming fabric and bonds about the warp and weft yarns.

The forming fabric may be woven as a single ply, two ply, or more than two ply.

Abrasion resisting polyurethane is arranged preferably as a plurality of continuous strips which are approximately 2 to 15 mm wide and which are arranged in substantially parallel rows. Alternatively, a single strip of polyurethane material which is also approximately 2 to 15 mm wide may be arranged in a plurality of spirals. Other arrangements for the abrasion resisting material in the abrasion resistant areas are contemplated and may comprise a plurality of interrupted strips of polyurethane extending along the length of the fabric or a plurality of polyurethane circular dots arranged along the length of the fabric. The abrasion resistant material may be on both the support surface and the running surface of the forming fabric.

The forming fabric is woven in any suitable weave pattern, preferably an Atlas, or satin weave pattern. The continuous filaments forming the forming fabric may be monofilament nylon, monofilament nylon-polyester blend, or monofilament polyester-fluorocarbon blend.

The abrasion resistant polyurethane is impregnated to penetrate and bond with and about the warp and weft filaments throughout the thickness of the forming fabric. The polyurethane forms protrusions on at least the running surface of the forming fabric.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
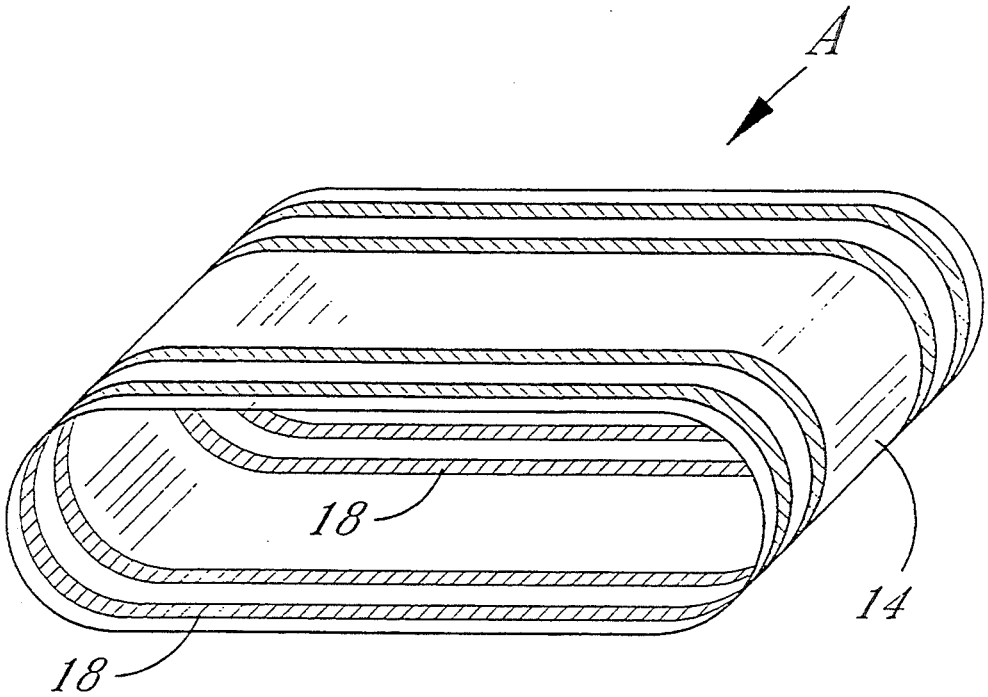
FIG. 1 is a perspective view of an endless forming fabric having strips of abrasion resisting material arranged in parallel abutting fashion adjacent opposed edges.

Referring now to FIG. 1, there is shown a continuous forming fabric A. The outer surface of continuous forming fabric A is referred to as the support surface or that surface which supports the paper product during paper forming. The inner surface of continuous forming fabric A is referred to as the running surface or that surface which contacts the machine rolls and suction boxes during paper forming.

Figure 6:
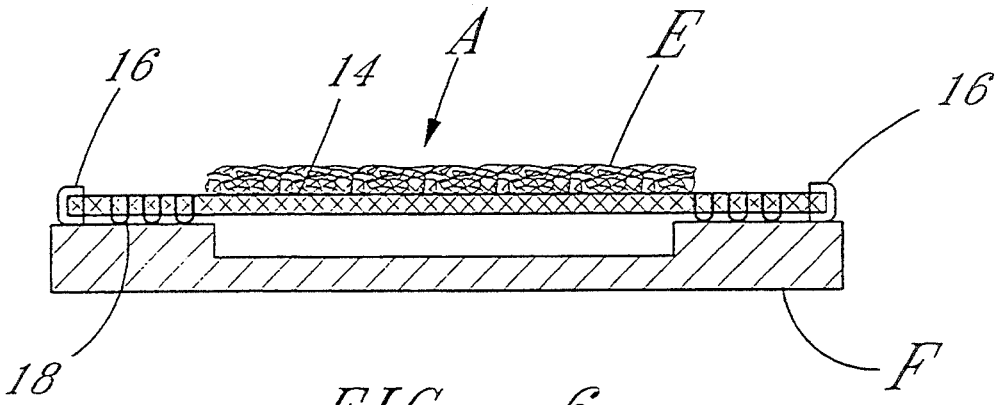
FIG. 6 is a sectional end view showing the forming fabric arranged relative to a suction box.

In use, the paper product which is in the form of a slurry, is deposited on the support surface of the forming fabric. In FIG. 6, paper product E can be seen distributed across the inner portion of the drier fabric A.

As the forming fabric A moves through the paper forming machine, it passes over a plurality of suction boxes, one of which is partially shown as F in FIG. 6. Suction box F acts to suck liquid from paper product E through forming fabric A. This action places great stress on the outer edges of forming fabric A which are in contact with outer edges of suction box F. This contact with the suction boxes F causes premature wear of the edge portions. In order to eliminate this premature wear, abrasion resistant strips 18 are formed along the outer edges of forming fabric A.

FIG. 1 shows forming fabric A having abrasion resistant strips 18 adjacent each edge portion thereof. The forming fabric A is woven, single-ply or multi-ply, with the most preferred arrangement being a two-ply satin weave. Any other known weave which is suitable for use with forming fabrics is also acceptable.

Forming fabric A is constructed of synthetic monofilament yarns which may be formed of polyester, nylon or polymer blends. Acceptable blends are polyester/nylon and polyester/fluorocarbon polymers. A most preferred fabric forming monofilament consists of a blend of between eighty percent and ninety-nine percent polyethylene-terephtalate and between one percent and twenty percent polymerized tetrafluoroethylene.

Forming fabrics generally have a porosity capability of between two hundred and eight hundred CFM. The fabrics also have a fiber retention capability of between sixty percent and eighty percent. It is extremely important that these two capabilities be maintained regardless of additional alterations to the forming fabric structure.

Figure 4:
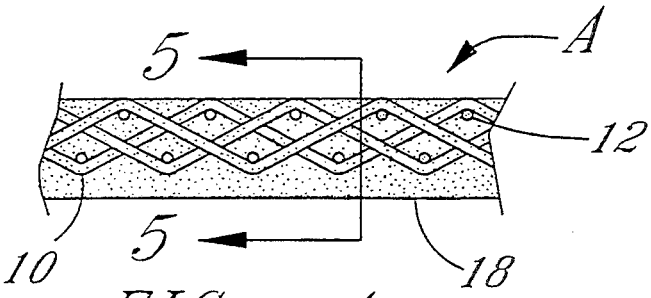
FIG. 4 is a side sectional view of the abrasion resisting material submerged with the interstices of the forming fabric.
Figure 5:
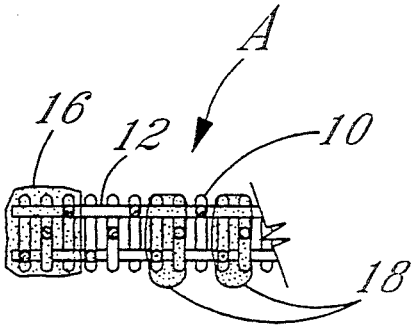
FIG. 5 is an end sectional view of the forming fabric having a plurality of strips of abrasion resisting material and having its edge sealed with a strip of abrasion resisting material.
Figure 3:
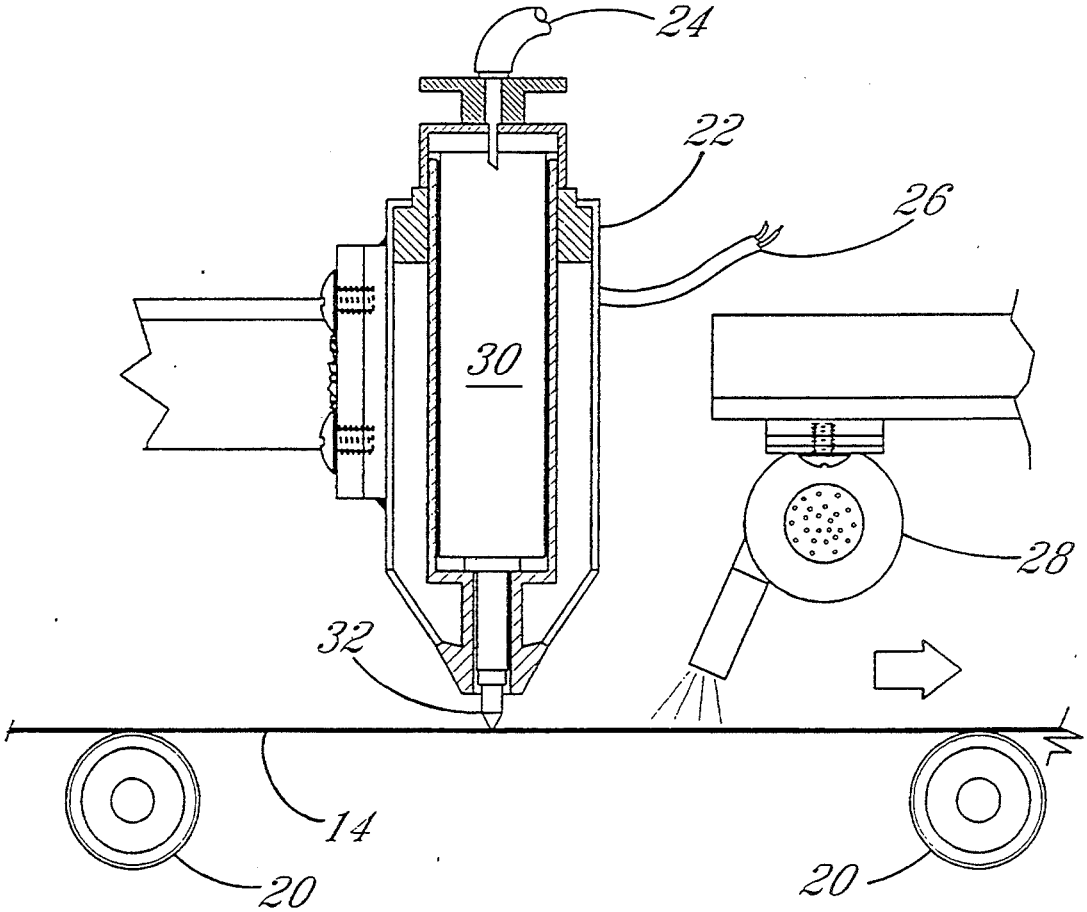
FIG. 3 is a side sectional view showing means applying strips of abrasion resisting material to an edge of a forming fabric.

Referring now to FIGS. 1, 4, and 5, forming fabric A is shown continuous with warp filaments 10 running in the machine direction and weft filaments 14 running transverse of the fabric. Filaments 10 and 12 are interwoven in a suitable weave pattern to form fabric 14. As can best be seen in FIGS. 1, 4, 5, and 6, outer edges of fabric 14 are preferably finished with an edge seal 16 which acts to resist abrasion and also acts to stabilize the edge structure of the forming fabric. Alternatively, the edge may simply be finished with a heat seal. The longitudinal area adjacent each edge of fabric 14 is coated with only a pair of abrasion resistant strips 18, however, as many as seven abrasion resistant strips 18 may be desirable. Abrasion resistant strips 18 are arranged parallel with opposed edges of fabric 14 and are also arranged to be parallel with each other. Strips 18 completely encircle fabric 14 so that their starting point abuts with their ending point.

As shown best in FIGS. 4, 5, and 6, the abrasion resistant material extends outwardly below the running surface in the form of strips 18. The abrasion resisting material is integrated in the interstices of fabric 14 so as to bond with and about warp and weft filaments 10 and 12. The abrasion resistant material preferably does not penetrate above the support surface of fabric 14 so as to not interfere with the drainage action from the paper product through the fabric. In certain instances, the strips 18 may appear on both fabric surfaces.

The abrasion resistant material is formed of a hot melt polyurethane resins. Polyurethane resins are most desirable because of their wear resistance qualities, their soft flexible characteristics and their ability to be unaffected by the heat generated during the paper forming operation. An equally important quality of polyurethane resins is their ability to bond with and adhere to monofilaments formed of polyester, nylon and particularly monofilaments formed of blends of polyester and fluorocarbon polymers.

The polyurethane resin employed as the abrasion resistant material is represented by the following formulas: $OCN—R_1—NCO+HO—R_2—OH \rightarrow OCN—[R_1—NHCO—O—R_2]—OH$. Preferably, the polyurethane has a softening temperature in a range of approximately 60°–70° C. One suitable hot-melt polyurethane is manufactured by Klebchemic M. G. Becker GmbH, 7504 Weingarten, Germany under the name Supramelt FU702.

Referring now to FIGS. 1, 3, 4, and 5, it can be seen that the polyurethane resin forming abrasion resistant strips 18 are applied to fabric 14 of forming fabric A in a heat melt state. In practice, fabric 14 is arranged to pass under tension over a pair of guide rolls 20. An applicator 22 is arranged in between the guide rolls and is accurately positioned adjacent the edge of the fabric. A supply 30 of the abrasion resisting material is positioned in a heated applicator 22 and in communication with nozzle 32. The polyurethane resin of supply 30 is heated by electric coils which are supplied by wire 26. When the polyurethane, which has been heated to between 60° and 100° Centigrade becomes liquified, the polyurethane is forced under pressure into fabric 14 as a hot melt adhesive by air supplied through line 24. The air pressure required to force the hot melt polyurethane through the nozzle and into the interstices of fabric is between forty PSI and sixty PSI, depending on the number of fabric plies and the yarn count.

Fabric 14 moves beneath nozzle 32 at a speed of approximately nine meters per minute. An air dryer 28 is arranged down stream of applicator 22 and is arranged to direct cool air under approximately thirty PSI onto the coated polyurethane strip to dry the polyurethane sufficiently so that it is not tacky by the time it reaches roll 20.

Figure 2:
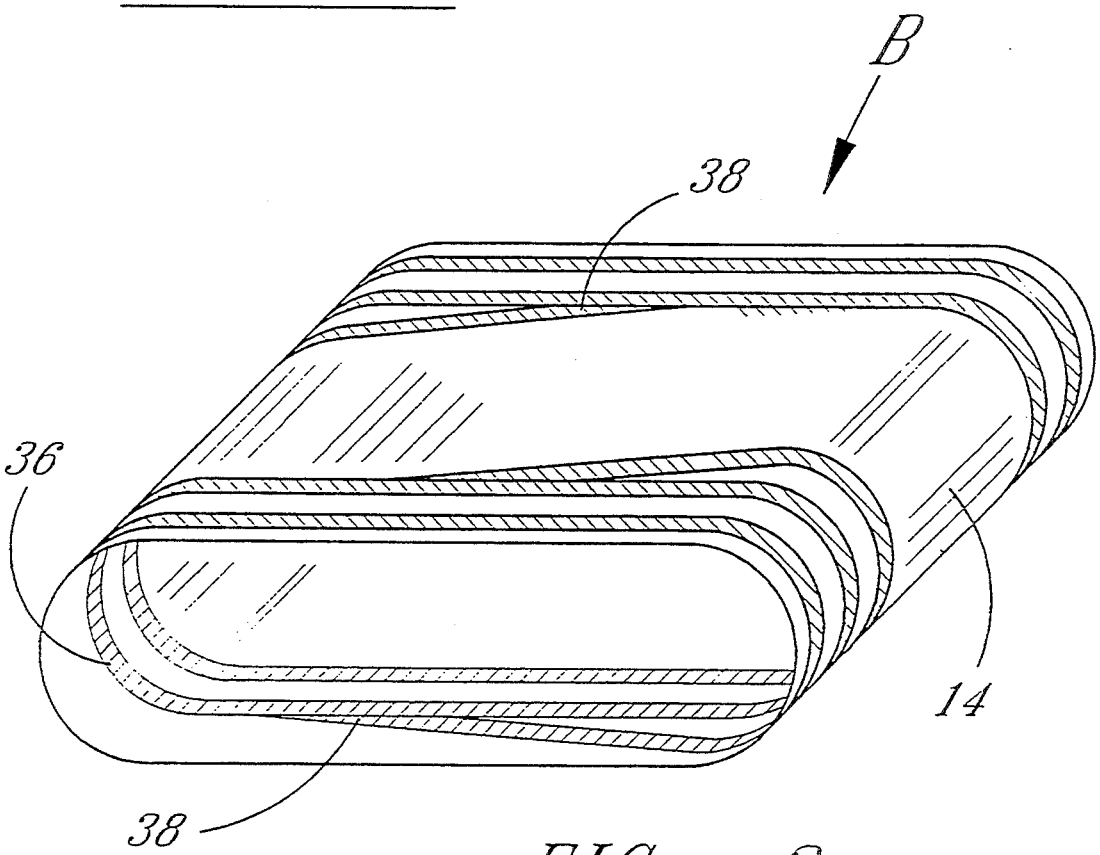
FIG. 2 is a perspective view similar to FIG. 1 but showing the strips of abrading material arranged in spiral fashion.
Figure 7:
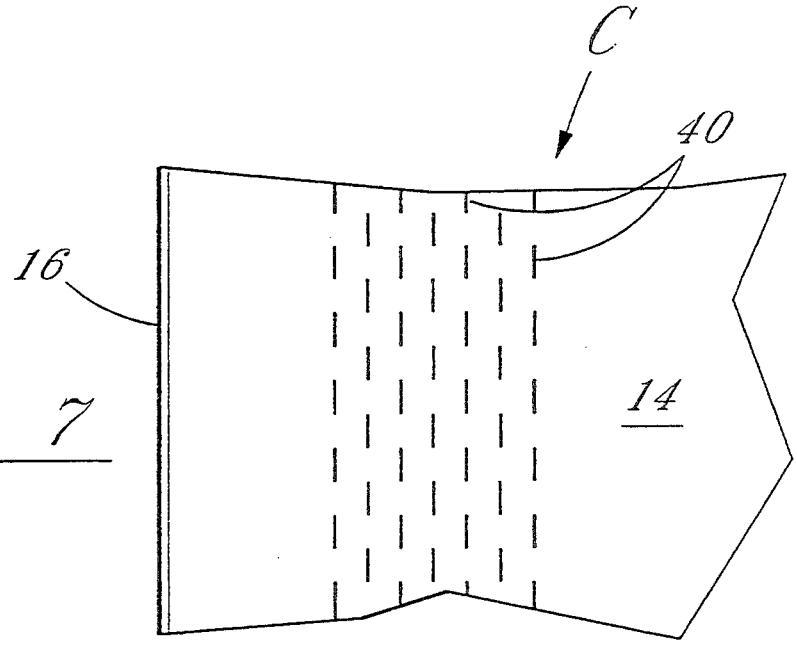
FIG. 7 is a top sectional view showing an alternative arrangement of the abrasion resisting strips.
Figure 8:
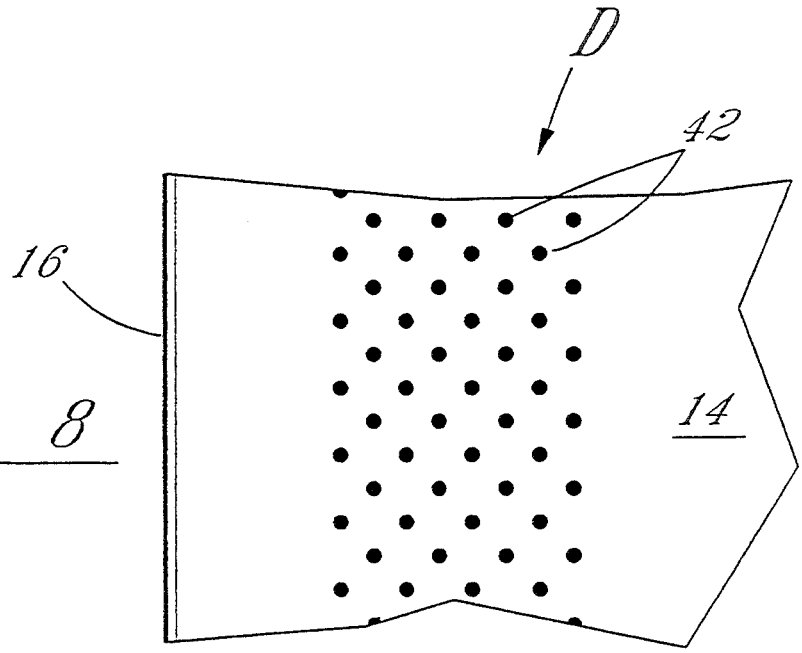
FIG. 8 is a top sectional view showing a second alternative arrangement of the abrasion resisting strips.

Other embodiments of the forming fabric having abrasion resistant strips along its outer edges are shown in FIGS. 2, 7 and 8. Referring now to FIG. 2, forming fabric B is provided with a continuous abrasion resistant strip 36 which is incorporated with fabric 14 as a continuous coil. Starting and stopping ends 38 of the coil are gradually merged with the adjacent strip as shown in the drawing.

FIG. 7 shows an alternative arrangement in which the abrasion resistant strips consist of a plurality of interrupted strips 40 arranged in parallel rows.

FIG. 8 shows yet another arrangement where the abrasion resistant strips comprise a plurality of parallel rows of dots 42.

While a preferred embodiment of the invention has been described using specific terms, such description is for illustrative purposes only, and it is to be understood that changes and variations may be made without departing from the spirit or scope of the following claims.

What is claimed is:

1. A continuous forming fabric for use in a papermaking machine woven of continuous filament warp and weft yarns to have a support surface and a running surface, said forming fabric including;

a pair of unfinished edges extending along the length of said forming fabric;

abrasion resistant areas extending along the length of said forming fabric adjacent respective of said opposed edges;

an abrasion resisting material arranged to cover at least a portion of said abrasion resistant areas of said running surface, said abrasion resisting material comprising a hot melt polyurethane impregnated onto said abrasion resistant areas to penetrate into the interstices of said forming fabric to bond with and about said warp and weft filaments; whereby a continuous and stable forming fabric is provided having abrasion resistant areas in which said abrasion resisting material bonds with the warp and weft yarns to interconnect them, said abrasion resisting materials being arranged to protrude below and over said abrasion resistant areas along the length of said running surface and said abrasion resisting materials being arranged to also protrude above at least a portion of said abrasive resistant areas along the length of said support surface.

2. The forming fabric of claim 1 wherein said unfinished edges are heat sealed and impregnated with a hot melt polyurethane coating to stabilize said edges, said coating extending below said running surface and below said support surface.

3. The forming fabric of claim 1 wherein said forming fabric is single ply.

4. The forming fabric of claim 1 wherein said forming fabric is at least two ply.

5. The forming fabric of claim 1 wherein said abrasion resisting material comprises a plurality of continuous strips of hot melt polyurethane arranged in substantially parallel rows each strip extending along a single axis.

6. The forming fabric of claim 1 wherein said abrasion resisting material comprises a single strip of hot melt polyurethane arranged in a plurality of spirals.

7. The forming fabric 1 wherein said abrasion resisting material comprises a plurality of interrupted strips of hot melt polyurethane, each said strip extending along a single axis along the length of said fabric.

8. The forming fabric of claim 1 wherein said abrasion resisting material comprises a plurality of polyurethane circular dots arranged along the length of said fabric.

9. The forming fabric of claim 1 wherein said continuous filaments are one of monofilament nylon, monofilament nylon polyester blend and monofilament polyester fluorocarbon blend.

10. The fabric of claim 1 wherein said polyurethane has a softening temperature of approximately 60°-70° C.

11. A forming fabric for use with a papermaking machine woven in one of a box, satin or Atlas weave of synthetic continuous warp and weft filaments;

said forming fabric having a support surface and a running surface, said running surface of said forming fabric having abrasion resistant areas arranged along its length and adjacent each edge;

said abrasion resistant areas having abrasion resistant polyurethane impregnated to penetrate completely said abrasions resistant area to bond with and about said warp and weft filaments throughout the thickness thereof, said polyurethane being flush with said support surface and forming protrusions on said running surface.

12. The forming fabric of claim 11 wherein said weave is multi-ply.

13. The forming fabric of claim 11 wherein said protrusions comprise a plurality of parallel strips of substantially 7 mm width.

14. The forming fabric of claim 11 wherein said polyurethane is represented by the formulas $OCN—R_1—NCO + HO—R_2—OH \rightarrow OCN—[R_1—NHCO—O—R_2—]—OH$.

15. The fabric of claim 11 wherein said polyurethane has a softening temperature of approximately 60°-70° C.

* * * * *